US008989428B2

(12) United States Patent
Hill et al.

(10) Patent No.: US 8,989,428 B2
(45) Date of Patent: Mar. 24, 2015

(54) ACOUSTIC SYSTEMS IN ELECTRONIC DEVICES

(75) Inventors: Matthew D. Hill, Mountain View, CA (US); Andrew Bright, San Francisco, CA (US); Christopher Wilk, Sunnyvale, CA (US); Teemu Pekka Silipä, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 643 days.

(21) Appl. No.: 13/232,222

(22) Filed: Sep. 14, 2011

(65) Prior Publication Data

US 2013/0051601 A1 Feb. 28, 2013

Related U.S. Application Data

(60) Provisional application No. 61/529,870, filed on Aug. 31, 2011.

(51) Int. Cl.

| | |
|---|---|
| ***H04R 25/00*** | (2006.01) |
| ***H04R 1/06*** | (2006.01) |
| ***H04R 1/28*** | (2006.01) |
| *H04R 1/10* | (2006.01) |

(52) U.S. Cl.

CPC ..... *H04R 1/06* (2013.01); *H04R 1/2892* (2013.01); *H04R 1/1075* (2013.01); *H04R 25/604* (2013.01); *H04R 2499/11* (2013.01)

USPC ..... 381/386; 381/394; 381/409

(58) Field of Classification Search

USPC ..... 381/332, 333, 334, 386, 394, 396, 409, 381/410; 379/428.01, 433.02, 433.05, 432, 379/438; 439/66, 91; 455/350, 351

See application file for complete search history.

(56) References Cited

U.S. PATENT DOCUMENTS

| | | | |
|---|---|---|---|
| 1,893,291 | A | 1/1933 | Kwartin |
| 4,068,103 | A | 1/1978 | King et al. |
| 4,081,631 | A | 3/1978 | Feder |
| 4,089,576 | A | 5/1978 | Barchet |

(Continued)

FOREIGN PATENT DOCUMENTS

| | | |
|---|---|---|
| EP | 2094032 | 8/2009 |
| GB | 2310559 | 8/1997 |

(Continued)

OTHER PUBLICATIONS

Baechtle et al., "Adjustable Audio Indicator," IBM, 2 pages, Jul. 1, 1984.

(Continued)

*Primary Examiner* — Huyen D Le

(74) *Attorney, Agent, or Firm* — Brownstein Hyatt Farber Schreck, LLP

(57) ABSTRACT

A mobile electronic device including a processor, a first electrical component including at least one contact area, and a second electrical component including at least one contact arm extending over a top surface of the second electrical component and secured in at least two locations, the at least one contact arm configured to be in electrical communication with the at least one contact area. In another embodiment, the electronic device further includes a microphone operably connected to an enclosure. A first resilient member coupled to the enclosure and a first side of the microphone and a second resilient member coupled to a second side of the microphone and a support structure within the enclosure.

21 Claims, 13 Drawing Sheets

(56) References Cited

U.S. PATENT DOCUMENTS

| | | | | |
|---|---|---|---|---|
| 4,245,642 | A | 1/1981 | Skubitz et al. | |
| 4,466,441 | A | 8/1984 | Skubitz et al. | |
| 4,658,425 | A | 4/1987 | Julstrom | |
| 5,106,318 | A | 4/1992 | Endo et al. | |
| 5,293,002 | A | 3/1994 | Grenet et al. | |
| 5,335,011 | A | 8/1994 | Addeo et al. | |
| 5,406,038 | A | 4/1995 | Reiff et al. | |
| 5,521,886 | A | 5/1996 | Hirosawa et al. | |
| 5,570,324 | A | 10/1996 | Geil | |
| 5,604,329 | A | 2/1997 | Kressner et al. | |
| 5,619,583 | A | 4/1997 | Page et al. | |
| 5,733,153 | A | 3/1998 | Takahashi et al. | |
| 5,879,598 | A | 3/1999 | McGrane | |
| 6,036,554 | A | 3/2000 | Koeda et al. | |
| 6,073,033 | A | 6/2000 | Campo | |
| 6,129,582 | A | 10/2000 | Wilhite et al. | |
| 6,151,401 | A | 11/2000 | Annaratone | |
| 6,154,551 | A | 11/2000 | Frenkel | |
| 6,192,253 | B1 | 2/2001 | Charlier et al. | |
| 6,317,237 | B1 | 11/2001 | Nakao et al. | |
| 6,400,825 | B1 * | 6/2002 | Miyamoto et al. | 381/409 |
| 6,553,126 | B2 | 4/2003 | Han et al. | |
| 6,700,987 | B2 | 3/2004 | Kuze et al. | |
| 6,813,218 | B1 | 11/2004 | Antonelli et al. | |
| 6,829,018 | B2 | 12/2004 | Lin et al. | |
| 6,882,335 | B2 | 4/2005 | Saarinen | |
| 6,892,850 | B2 | 5/2005 | Suzuki et al. | |
| 6,934,394 | B1 | 8/2005 | Anderson | |
| 7,003,099 | B1 | 2/2006 | Zhang et al. | |
| 7,082,322 | B2 | 7/2006 | Harano | |
| 7,116,795 | B2 | 10/2006 | Tuason et al. | |
| 7,154,526 | B2 | 12/2006 | Foote et al. | |
| 7,158,647 | B2 | 1/2007 | Azima et al. | |
| 7,263,373 | B2 | 8/2007 | Mattisson | |
| 7,266,189 | B1 | 9/2007 | Day | |
| 7,362,877 | B2 * | 4/2008 | Honda et al. | 381/409 |
| 7,378,963 | B1 | 5/2008 | Begault et al. | |
| 7,527,523 | B2 | 5/2009 | Yohn et al. | |
| 7,536,029 | B2 | 5/2009 | Choi et al. | |
| 7,570,772 | B2 | 8/2009 | Sorensen et al. | |
| 7,679,923 | B2 | 3/2010 | Inagaki et al. | |
| 7,792,320 | B2 | 9/2010 | Proni | |
| 7,867,001 | B2 | 1/2011 | Ambo et al. | |
| 7,878,869 | B2 | 2/2011 | Murano et al. | |
| 7,903,061 | B2 | 3/2011 | Zhang et al. | |
| 7,912,242 | B2 | 3/2011 | Hikichi | |
| 7,966,785 | B2 | 6/2011 | Zadesky et al. | |
| 8,031,853 | B2 | 10/2011 | Bathurst et al. | |
| 8,055,003 | B2 | 11/2011 | Mittleman et al. | |
| 8,116,505 | B2 | 2/2012 | Kawasaki-Hedges et al. | |
| 8,116,506 | B2 | 2/2012 | Kuroda et al. | |
| 8,226,446 | B2 | 7/2012 | Kondo et al. | |
| 8,264,777 | B2 | 9/2012 | Skipor et al. | |
| 8,409,417 | B2 | 4/2013 | Wu | |
| 8,447,054 | B2 | 5/2013 | Bharatan et al. | |
| 8,488,817 | B2 | 7/2013 | Mittleman et al. | |
| 8,574,004 | B1 | 11/2013 | Tarchinski et al. | |
| 8,620,162 | B2 | 12/2013 | Mittleman | |
| 8,632,670 | B2 | 1/2014 | Garimella et al. | |
| 2004/0203520 | A1 | 10/2004 | Schirtzinger et al. | |
| 2005/0271216 | A1 | 12/2005 | Lashkari | |
| 2006/0072248 | A1 | 4/2006 | Watanabe et al. | |
| 2008/0204379 | A1 | 8/2008 | Perez-Noguera | |
| 2008/0292112 | A1 | 11/2008 | Valenzuela et al. | |
| 2008/0310663 | A1 | 12/2008 | Shirasaka et al. | |
| 2009/0247237 | A1 | 10/2009 | Mittleman et al. | |
| 2009/0274315 | A1 | 11/2009 | Carnes et al. | |
| 2009/0316943 | A1 | 12/2009 | Frigola Munoz et al. | |
| 2010/0062627 | A1 | 3/2010 | Ambo et al. | |
| 2010/0103776 | A1 | 4/2010 | Chan | |
| 2011/0002487 | A1 | 1/2011 | Panther et al. | |
| 2011/0033064 | A1 | 2/2011 | Johnson et al. | |
| 2011/0161074 | A1 | 6/2011 | Pance et al. | |
| 2011/0274303 | A1 | 11/2011 | Filson et al. | |
| 2012/0082317 | A1 | 4/2012 | Pance et al. | |
| 2012/0177237 | A1 | 7/2012 | Shukla et al. | |
| 2012/0250928 | A1 | 10/2012 | Pance et al. | |
| 2012/0263019 | A1 | 10/2012 | Armstong-Muntner | |
| 2013/0017738 | A1 | 1/2013 | Asakuma et al. | |
| 2013/0129122 | A1 | 5/2013 | Johnson et al. | |
| 2013/0164999 | A1 | 6/2013 | Ge et al. | |
| 2013/0259281 | A1 | 10/2013 | Filson et al. | |
| 2013/0280965 | A1 | 10/2013 | Kojyo | |
| 2014/0093113 | A1 | 4/2014 | Dix et al. | |
| 2014/0113478 | A1 | 4/2014 | Yeung et al. | |
| 2014/0140558 | A1 | 5/2014 | Kwong | |
| 2014/0250657 | A1 | 9/2014 | Stanley et al. | |

FOREIGN PATENT DOCUMENTS

| | | |
|---|---|---|
| GB | 2342802 | 4/2000 |
| JP | 2102905 | 4/1990 |
| JP | 2004153018 | 5/2004 |
| JP | 2006297828 | 11/2006 |
| WO | WO03/049494 | 6/2003 |
| WO | WO2004/025938 | 3/2004 |
| WO | WO2007/083894 | 7/2007 |
| WO | WO2008/153639 | 12/2008 |
| WO | WO2009/017280 | 2/2009 |
| WO | WO2011/057346 | 5/2011 |
| WO | WO2011/061483 | 5/2011 |

OTHER PUBLICATIONS

Pingali et al., "Audio-Visual Tracking for Natural Interactivity," Bell Laboratories, Lucent Technologies, pp. 373-382, Oct. 1999.

Blankenbach et al., "Bistable Electrowetting Displays," https://spie.org/x43687.xml, 3 pages, Jan. 3, 2011.

* cited by examiner

ACOUSTIC SYSTEMS IN ELECTRONIC DEVICES

CROSS REFERENCE TO RELATED APPLICATIONS

The present application claims the benefit under claims benefit under 35 U.S.C. §119(e) to U.S. Provisional Patent Application No. 61/529,870, filed Aug. 31, 2011 and titled "Acoustic Systems in Electronic Devices," the disclosure of which is hereby incorporated herein in its entirety.

TECHNICAL FIELD

The present invention relates generally to electronic devices and more specifically, to mobile electronic devices.

BACKGROUND

Electronic devices such as smart phones, mobile gaming devices, laptops, and so on may include vibration generators and/or haptic feedback generators, such as a vibrating alert (eccentric rotating weight), speakers, motors, and so on. These electronic devices may also include an audio sensor, such as a microphone. Often, the audio sensor may pick up the vibrations or other undesired mechanical movements. This may cause the audio sensor to transmit or otherwise record these vibrations.

Furthermore, audio receivers, or other audio output devices, and other electronic components may be dislocated or otherwise disconnected from an electrical contact due to vibrations in the device, a user dropping the device, or other forces experienced by the electronic device. The loose electrical contacts may degrade the quality of the audio receiver or other electrical component, or may completely prevent the audio receiver or other electrical component from functioning.

SUMMARY

Examples of embodiments described herein may take the form of an electronic device. The electronic device may include an enclosure and a microphone operably connected to the enclosure. The microphone is coupled to the enclosure via a first resilient member coupled to the enclosure and a first side of the microphone. A second resilient member is coupled to the second side of the microphone and another support structure.

Other embodiments may take the form of an electronic device including a processor and a connection component in communication with the processor. The electronic device further includes an audio output device in communication with the connection component. The audio output device includes at least one contact arm operably connected at a first end to a first location of the audio output device and at a second end to a second location of the audio output device, where the contact arm operably couples the audio output device to the connection component.

Still other embodiments may include a mobile electronic device. The mobile electronic device may include a processor, a first electrical component and a second electrical component. The first electrical component is in communication with the processor and includes at least one communication or contact area. The second electrical component includes at least one contact arm extending over a top surface of the second electrical component and movably secured to the second electrical component in at least two locations. The at least one contact arm is configured to be in electrical communication with the at least one communication or contact area.

SPECIFICATION

Figure 1:
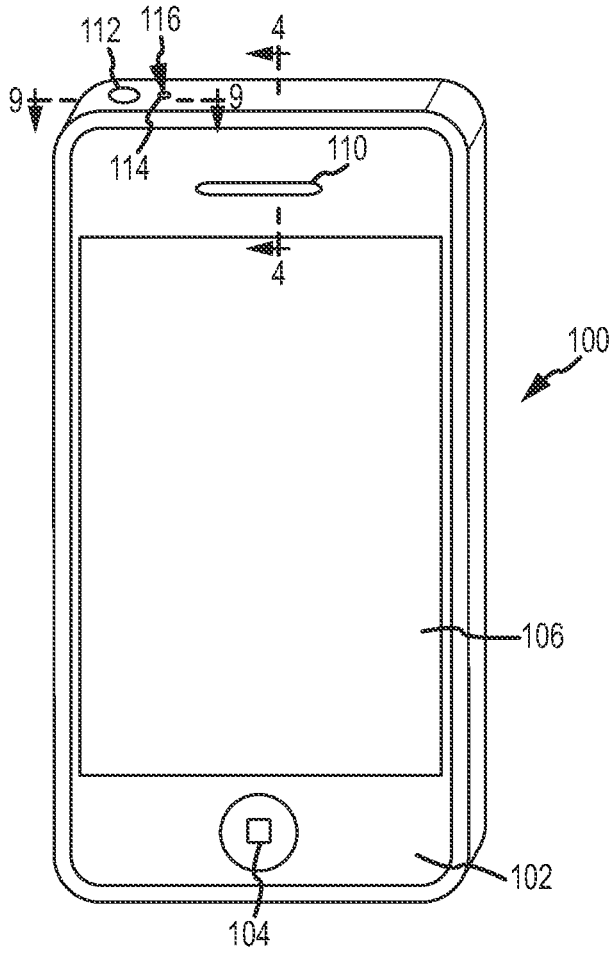
FIG. 1 is an isometric view of an electronic device.

Some embodiments described herein may take the form of various acoustic systems incorporated into, or forming, electronic devices. One example acoustic system may include an audio receiver or other similarly functioning electrical component, generally referred to herein as a "receiver," "audio receiver" or "audio output device." The audio receiver includes a contact arm that is flexible yet secured. The contact arm may include an electrical contact for connecting to an electrically conductive area on a printed circuit board, flex cable, or other electrical input. The arms may be supported on a first side of the audio receiver and may wrap over and around at least one side (e.g., the top, bottom, front back, left and/or right) of the audio receiver or audio output device and be movably secured to a second side of the audio receiver.

In one embodiment, each of the arms may be movably secured to the second side of the audio receiver so that they may be substantially restrained from moving along at least two axes, but may be able to move along at least one axis. In one example, the contact arms may move vertically but not horizontally or laterally, or minimally in such directions. Further, the arms may be spring-loaded or otherwise biased away from the receiver body. This may allow the contact arms to be flexible, while still being rigid enough to maintain the electrical connection between the audio receiver or first electrical component and a second electrical component (e.g., circuit board) when under pressure, such as when the receiver is incorporated into a larger electronic device and secured in position against the second electrical component. As one example, receivers in mobile telephones may vibrate when a haptic device is actuated, such as the vibrator used when the phone is in a silent mode. This vibration may cause the receiver to shift horizontally or laterally, thus breaking an electrical contact between the receiver and the circuit board. The arms of the present embodiment may exert force against the circuit board, thereby resisting the afore-described "walking" motion when the receiver vibrates.

In addition to assisting in maintaining the electrical connection between the audio receiver and the connecting (e.g., second) electrical component, the contact arms simplify or facilitate the assembly or stacking of the electrical components during manufacture of the electronic device. The arms are secured in place and may therefore be less likely to get caught on the second electrical component, other components, or become deformed during the manufacturing process.

Another embodiment of the acoustic system may include an acoustic coupling assembly. The acoustic coupling assembly provides an acoustical seal via a mechanical attachment for an audio sensor (e.g., microphone) or other vibration sensitive component that also decouples the audio sensor from the structure. This generally allows the audio sensor to be less likely to produce feedback (due to the acoustic seal) as well as prevent the audio sensor from sensing undesired sounds or vibrations that may be preset in the electronic device.

Figure 2:
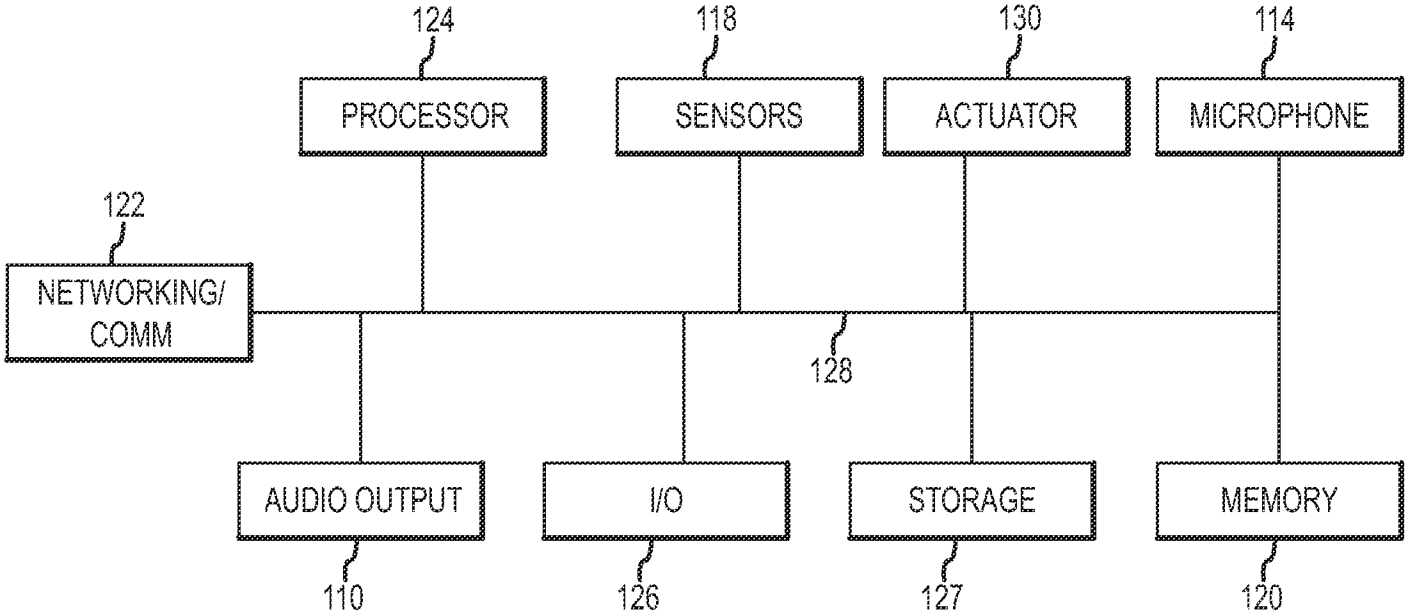
FIG. 2 is an exemplary block diagram of the electronic device.

FIG. 1 is an isometric view of a sample electronic device 100, specifically a mobile smartphone. FIG. 2 is an exemplary block diagram of the electronic device 100. Although a smartphone is depicted, the electronic device 100 may take virtually any form, including a laptop, digital camera, input device (e.g., mouse, keyboard, remote control, gaming controller and the like), headphones/headset, hearing aid device, and so on. Generally, embodiments herein will be described with reference to a smartphone as the electronic device for the sake of convenience.

The electronic device 100 may include an enclosure 102 that may form a portion of an exterior of the electronic device 100, and may at least partially enclose the various internal components of the electronic device 100. The electronic device 100 may also include an input member 104, a display screen 106, an audio receiver 110, an input port 112, and an audio input device 114.

The input member 104 (which may be a switch, capacitive sensor, or other input mechanism) allows a user to interact with the electronic device 100. For example, the input member 104 may be a button or switch to alter the volume, return to a home screen, or the like. Additionally, the input member 104 may be virtually any size, shape, and may be located in any area of the mobile computing device 100. Furthermore, the input member 104 may be combined with the display screen 106 as a capacitive touch screen.

The display screen 106 provides a visual output for the electronic device 100. The display screen 106 may be substantially any type of video output mechanism, such as a liquid crystal display, plasma display, and so on. In some embodiments, the display screen 106 may also function as an input/output mechanism. As mentioned above, the display screen 106 may be a capacitive touch screen to allow a user to provide inputs to the electronic device 100.

The audio receiver 110 may be substantially any component that may provide an audio output. For example, the audio receiver 110 may be a speaker or receiver that may produce sound waves in response to an electrical signal. The electronic device 100 may include multiple audio output devices 110. For example, if the electronic device 100 is a cellular phone, it may have a first audio output device for providing a sound output as the user is talking on the phone (e.g., an earpiece speaker) and a second audio output device for when the user listening to music (e.g., external speaker).

The input port 112 is configured to receive a plug such as an analog audio plug, charging cord, output device, a tip ring sleeve connector, and the like. The receiving port 112 is formed in the enclosure 102 to electrically connect an external device (e.g., headphones, speakers) to one or more internal components of the mobile computing device 100.

The audio sensor 114 may be a microphone or other mechanism that converts sound waves into electrical signals. The audio sensor 114 may be contained within the enclosure 102; however, the enclosure 102 and/or other components of the device 100 may define an audio path for sound waves to travel from outside the enclosure 102 to the audio sensor 114. For example, as shown in FIG. 1, the sensor 114 is contained within an audio port 116.

Referring now to FIG. 2, a block diagram of an embodiment of the mobile computing device 100 illustrating additional select electrical components. The mobile computing device 100 may include sensors 118, an actuator 130, a processor 124, memory 120, a network/communication interface 122, and an input/output interface 126 all connected together by a system bus 128. The mobile computing device 100 may include additional components that are not shown; and FIG. 2 is meant to be exemplary only.

The sensors 118 may be substantially any type of sensor, such as an image sensor (e.g., camera), a movement sensor (e.g., accelerometer, gyroscope), light sensor, and so on. Additionally, the electronic device 100 may include more than one sensor, and thus incorporate different sensor types or the same sensor types. For example, the device 100 may include two accelerometers, an image sensor, and a light sensor. The sensor 118 may provide information to the processor 124 regarding the device 100, such as the ambient light surrounding the device, movements of the device 100, and so on.

The actuator 130 may be substantially any type of motorized component or vibration-inducing component. For example, the actuator 120 may be a motor coupled to an eccentric weight to provide a vibration alert for the electronic device 100. In another example, actuator 120 may be a motor to drive a fan, a spinning disc for a hard drive and so on. In another example, the actuator 130 may be a device configured to provide a haptic feedback for the device 100, such as a piezoelectric component, or moving component.

The network/communication interface 122 may receive and transmit various electrical signals. For example, the network/communication interface 122 may be used to place phone calls from the mobile computing device 100, may be used to receive data from a network, or may be used to send and transmit electronic signals via a wireless or wired connection (e.g., Internet, WiFi, Bluetooth, or Ethernet).

The memory 120 may store electronic data that may be utilized by mobile computing device 100. For example, the memory 120 may store electrical data e.g., audio files, video files, document files, and so on, corresponding to various applications. The memory 120 may be, for example, non-volatile storage, a magnetic storage medium, optical storage medium, magneto-optical storage medium, read only memory, random access memory, erasable programmable memory, or flash memory.

The processor 124 may control operation of the mobile computing device 100 and its various components. The processor 124 may be in communication with the sensors 118, the actuator 130, the audio sensor 114, as well as with the audio receiver 110. The processor 124 may be any electronic device cable of processing, receiving, and/or transmitting instructions. For example, the processor 124 may be a microprocessor or a microcomputer.

The input/output interface 126 facilitates communication by the mobile computing device 100 to and from a variety of devices/sources. For example, the input/output interface 126 may receive data from user, control buttons on the mobile computing device 100, and so on. Additionally, the input/output interface 126 may also receive/transmit data to and from an external drive, e.g., a universal serial bus (USB), or other video/audio/data inputs.

Audio Output Device

Figure 4:
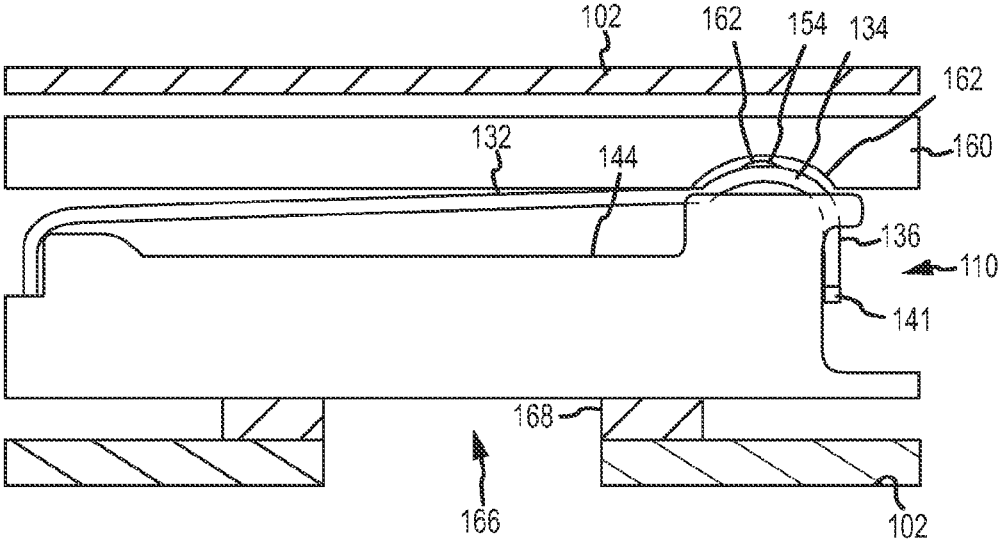
FIG. 4 is a cross-section view of the electronic device of FIG. 1 taken along line 4-4 in FIG. 1.

FIG. 4 is a cross-sectional view of the electronic device 100 illustrating the audio receiver 110 operably coupled to a connection component 160 and the enclosure 102. As briefly described above, the audio receiver 110 provides an audio output in response to an electronic signal. For example, the audio receiver 110 may be used as an earpiece or speaker for the electronic device 100. It should be noted that, in other embodiments, the contact arms as described herein may be used with substantially any other electrical component other than an audio output device.

Figure 5:
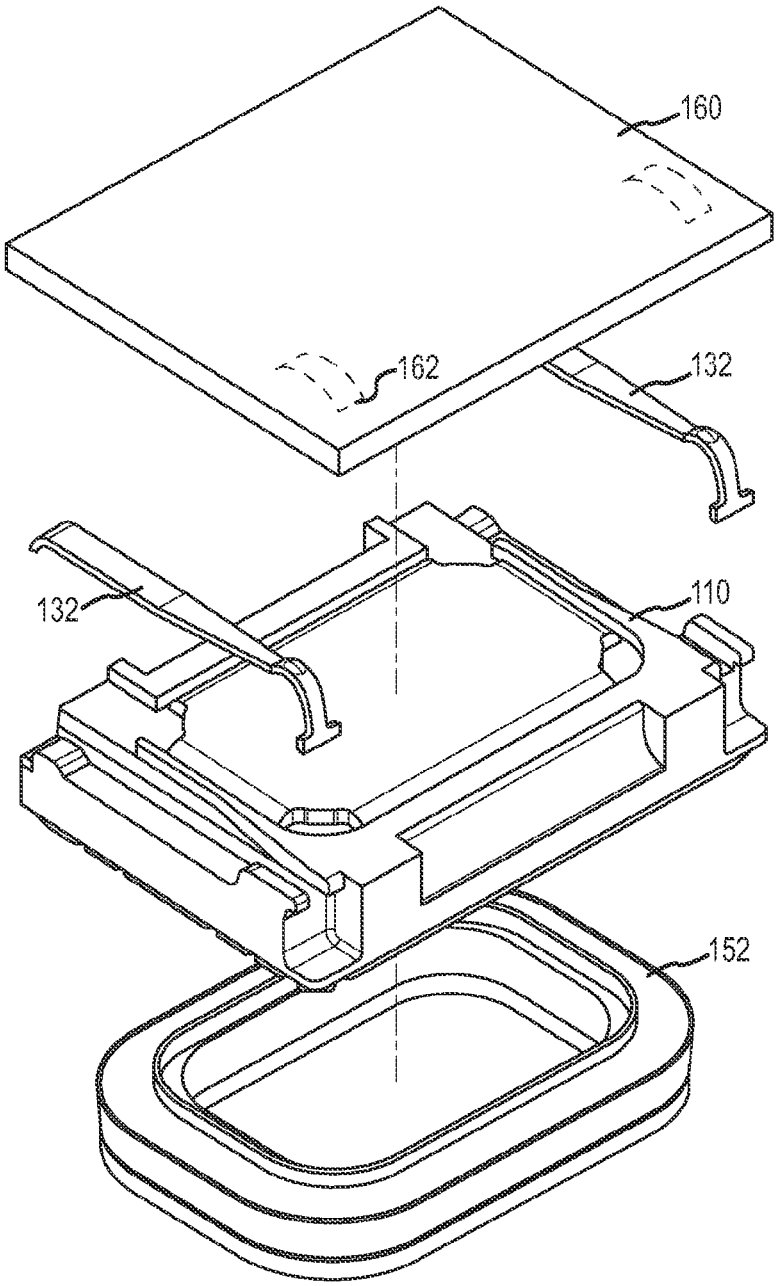
FIG. 5 is an exploded isometric view of an exemplary assembly of the audio receiver, circuit, and sealing member removed from the electronic device.

FIG. 5 is an exploded isometric view of the audio receiver 110, the connection component 160, and a seal 164. Referring to FIGS. 4 and 5, the audio receiver 110 may be secured within the electronic device 100 between a front side and a back side of the enclosure 102. In one embodiment, the front side of the enclosure 102 may be a cover glass that may cover the display 106 as well as the audio receiver 110. The front side of the enclosure 102 may include an output aperture 166 exposing a portion of the audio receiver 110. This may allow the sound waves and/or vibrations created by the audio receiver 110 be heard by a user, as the waves may not be blocked by the enclosure 102.

The audio receiver 110 may be secured to the enclosure 102 via a sealing member 164. The sealing member 164 may be positioned on an inner surface 168 of the enclosure 102 surrounding the output aperture 166. The sealing member 164 may help to prevent debris or other items from entering into the inner volume of the electronic device 100, even though the outlet aperture 166 is exposes a portion of the inner volume. The sealing member 164 may be practically any type of material that may form a seal, such as rubber, silicone, plastic, and so on.

A base 146 or bottom member of the audio receiver 110 rests on the sealing member 164 and the connection component 160 is positioned over a top surface 144 of the audio receiver 110. In some embodiments, the connection component 160 may not be in contact with the top surface 144 of the audio receiver 110, but may be secured above and adjacent to the top surface 144. In other embodiments the connection component physically abuts the top surface. Regardless, the connection component 160 may be positioned close enough to the top surface 144 to exert a downward force on at least one contact arm 132 of the audio receiver 110. Thus, as described in more detail below with respect to FIGS. 3A and 3B, when the connection component 160 is secured in place, the contact arms 132 may be forced into a compressed position, thus reducing the distance between them and the top surface 144 of the receiver.

The connection component 160 may be a printed circuit board, a flex cable, or another type of electrical connection component. The connection component 160 may be in communication with the processor 124 and may provide electrical signals to the audio receiver 110. In response the audio receiver 110 produces sound waves.

Figure 3A:
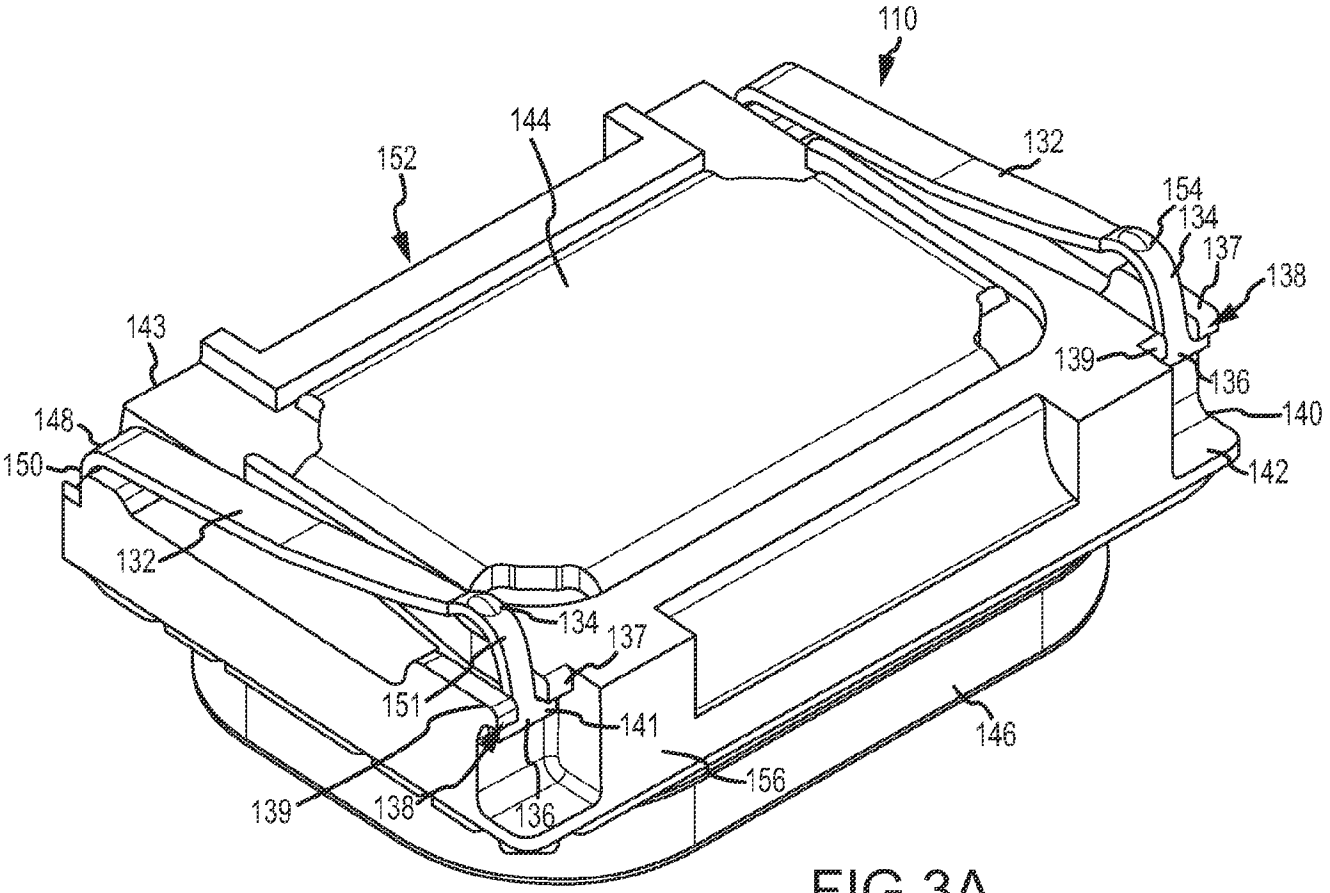
FIG. 3A is an isometric view of an audio receiver removed from the electronic device with contact arms in a first position.
Figure 3B:
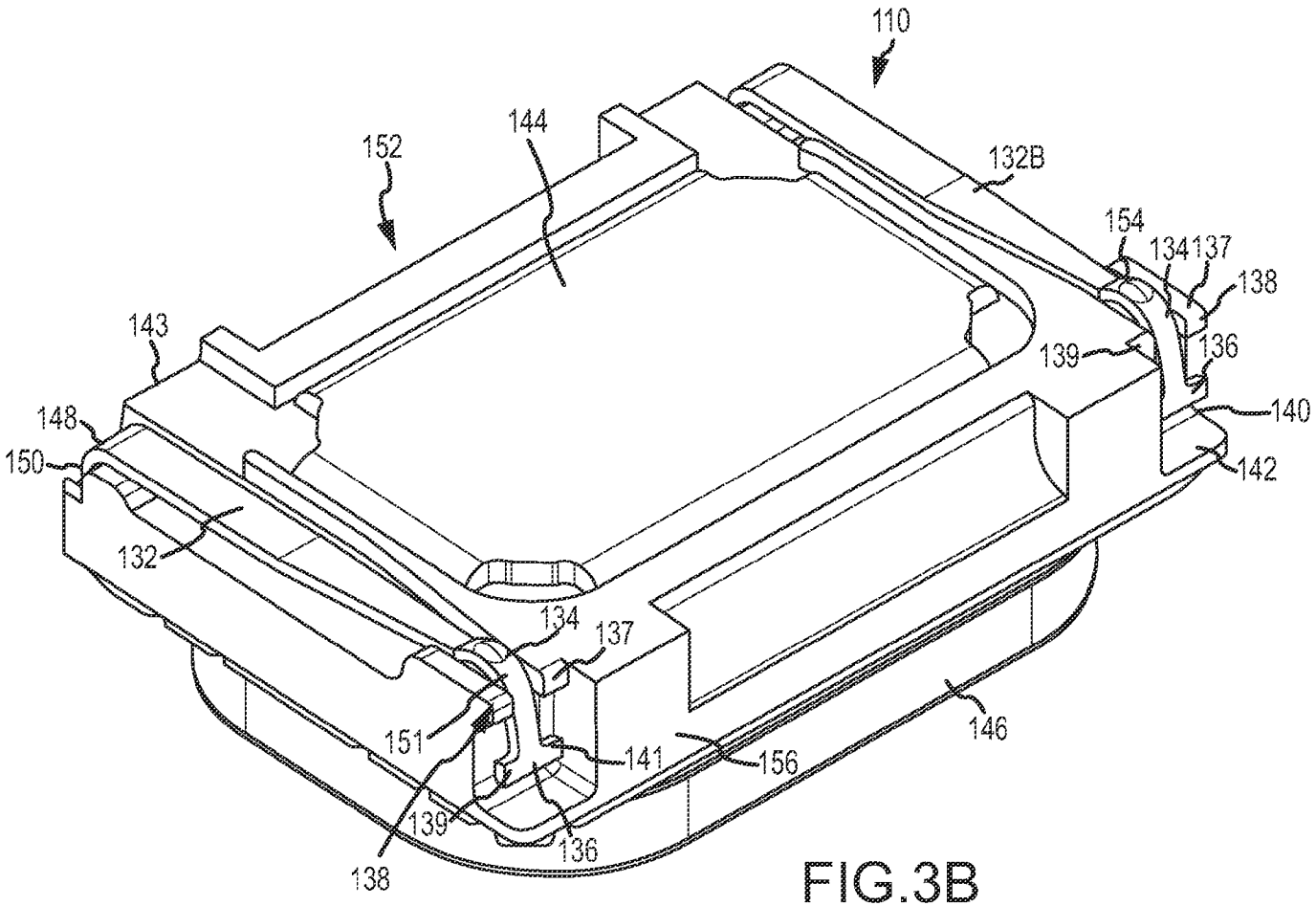
FIG. 3B is an isometric view of the audio receiver of FIG. 3A with the contact arms in a second position.

Next, the audio receiver 110 will be discussed in further detail with respect to FIGS. 3A and 3B. FIG. 3A is an isometric view of the audio output device 110 removed from the electronic device 100 with its contact arms in a first position. FIG. 3B is an isometric view of the audio receiver 110 with the contact arms in a second position. The audio receiver 110 may include a main body 152 having a top surface 144 and a bottom surface connected to a base 146.

The audio output device 110 receives an electrical signal from the processor 124 via one or more contact arms 132. The contact arms 132 are positioned on a first side 143 of the audio receiver 110 and secured in place on the first side 143 at the arm base 150. The base 150 may be integrally formed with the main body 152 of the audio receiver 110, or may be adhered or otherwise mechanically fastened to the main body 152 at the first side 143. Each contact arm 132 extends up from the base 150 and curves at a hinge 148 to traverse the top surface 144 of the audio receiver 110.

Each contact arm 132 extends substantially longitudinally across the top surface 144. The contact arms 132 may generally run along the top surface 144 and are typically, although not necessary, parallel to one another and to the top edges of top surface 144. In other embodiments, the contact arms 132 may extend at an angle or otherwise across the top surface 144, see, e.g., FIG. 6.

As shown in FIG. 3A, in the extended or first position, the contact arms 132 extend at an angle upwards from the hinge 148 as they traverse over the top surface 144. However, as shown in FIG. 3B, in the compressed or second position, the contact arms 132 may extend substantially parallel to the top surface 144. The hinge 148 and the base 150 act as a compressive spring contact, while allowing the contact arm 132 to flex, but also be secured. This allows the contact arms 132 to have a first height and first angle with respect to the top surface 144 in the first position and to have a second height and a second angle in the second position.

Each contact arm 132 includes an electrical contact 134 or a communication area on a raised or elevated portion of each contact arm 132. The electrical contact 134 may include a raised ridge, bump or other projection that may correspond to an indent, detent, or other keying structure on a corresponding connection component 160 (see, e.g., FIG. 4), cable or other electrical component.

The electrical contact 134 may further include a keying structure 154 such as a raised bump on the top surface of the electrical contact 134. The keying structure 154 may be the main contact location for the contact arm 134, and also may help to secure the audio receiver 110 in position (this is discussed in more detail below with respect to FIG. 4).

After the keying structure 154, the contact arm 134 may transition to a bend 152. The bend 152 allows the contact arm 134 to trace the main body 152 as it transactions from the top surface 144 to a second side 156.

The contact arms 132 may terminate in a locking feature 136. The locking feature 136 may interact with a base body extension 138 or sidewall to prevent the contact arm 132 from disengaging from the second side 156 of the audio receiver 110. The locking feature 136 in combination with the base body extension 138 allows the contact arms 132 to move upward and downward relative to the top surface 144, but may substantially prevent movement upwards past a certain point. Further, the locking feature 136, the base body extension 138, and a groove 140 in which the locking feature 136 travels, may prevent the contact arm 132 from moving in a lateral or horizontal direction.

For example, in one embodiment the locking feature 136 may be a "T" shaped member that when the contact arms 132 are fully extended and not under any downward force, engages with a first and second sidewall 137, 139 of the base body extension 138. The branches 141 of the "T" may prevent the contact arm 132 from extending upwards past a certain height as the branches 141 may engage each sidewall 137, 139 holding the branches 141 in place. However, the groove 140 may be sufficiently wide enough along its length so that the branches 141 may allow the locking feature 136 (and thus the contact arms 132) to move downward within the groove 141.

The locking feature 136 may prevent the contact arms 132 from becoming caught on components while the electronic device 100 is assembled. This is discussed in more detail below with respect to FIGS. 8A and 8B. Additionally, the locking feature 136 helps to maintain the keying structure 154 and the contact 134 in the correct or connective position. For example, in some embodiments, the audio receiver 110 may vibrate while operating, which could cause the contact arms 132 (if not secured via the locking feature 136) to move or "walk" around, thus degrading the connection to a connection component or disconnecting the connection.

As the locking structure 136 may also help prevent the contacts 134 and the keying structure 154 from moving out of position, the locking structure 136 may also substantially prevent debris from gathering on the contact 134 and/or keying structure 152. As the contacts 134 may be substantially prevented from moving along the outer bottom surface of the connection component 160, they may be less likely to gather debris, which may gather on the outer surface of the connection component 160. For example, as the audio receiver 110 and/or the connection component 160 may be exposed through the enclosure 102 (to allow sound waves to pass therethrough), debris may gather on either or both components. Thus, by preventing the contacts 134 from "walking around" the debris may not be positioned between the contacts 134 and the connection area of the connection component 160.

In some embodiments, the base body extension 138 may be positioned lower in the groove 140, so that the contact arms 132 may be pretensioned. In these embodiments, the locking feature 136 of the contact arms 132 may be engaged with the base body extension 138 at a lower location in the groove 140, thus exerting a downward force against the arms 132. In the pretensioned position the contact arms 132 may be slightly compressed, but not completely forced into the compressed position of FIGS. 3B and 3C.

Referring to FIGS. 3A-3D, when a downward force is applied to the contact arms 134, the locking feature 136 may move downward in the groove 140. As the locking feature 136 moves downward into the groove 140, the contact arms 132 transition to a compressed position in which the arms 132 are closer to the top surface 144 of the audio receiver 110. The hinge 148 allows the contact arms 132 to bend and the base body extension members 137, 138 substantially prevent movement of the locking feature 136 along a horizontal axis.

In another example, the groove 140 may provide a track in which the locking structure 136 may move. The locking feature 136 may include an engagement feature corresponding to an engagement feature of the groove 140 to help restrain lateral movement of the locking feature 136.

Once the downward force is removed, and if the contact arm 134 is not secured in the compressed position, the contact arms 132 may return to the extended position. That is, the contact arms 132 may have sufficient resiliency and the hinge 148 may provide an upward, restoring force. When the restoring force is not resisted by the arms 132, perhaps due to pre-tensioning, the contact arms 132 will move upward. Additionally, because the locking feature 136 may cooperate with the sidewalls 137, 139 of the base extension portion 138 to prevent the contact arms 132 from an extending past a particular height or moving past a particular position, the contact arms 132 may return to their original non-compressed position but are generally prevented from extending any further.

Figure 3C:
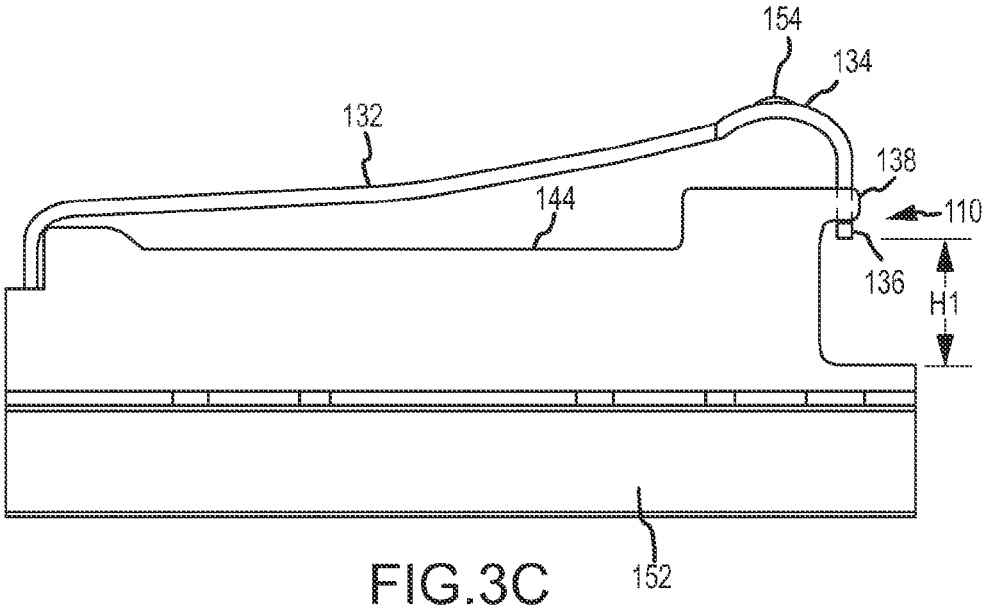
FIG. 3C is a side elevation view of the audio receiver of FIG. 3A with the contact arms in the first position.
Figure 3D:
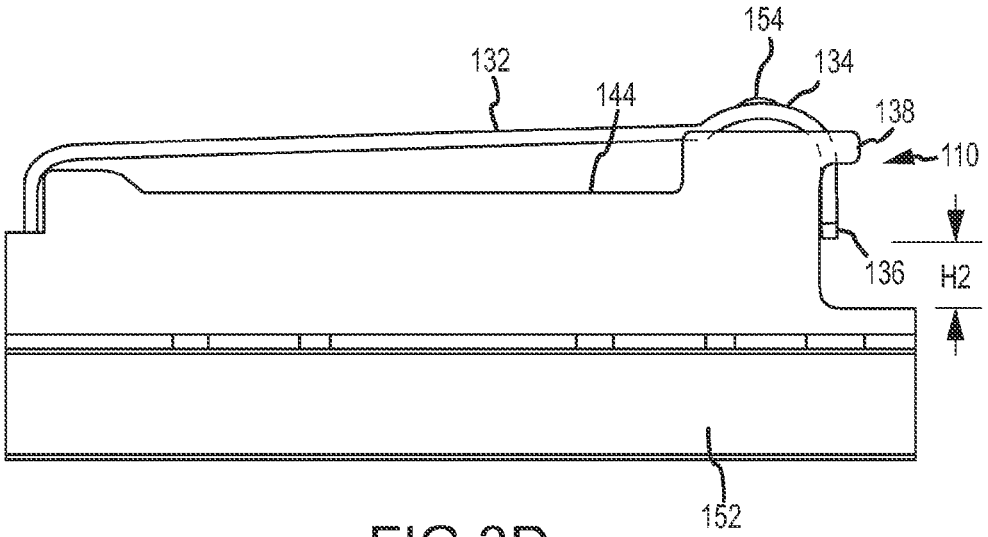
FIG. 3D is a side elevation view of the audio receiver of FIG. 3B with the contact arms in the second position.

FIG. 3C illustrates the contact arms 132 in an extended position and FIG. 3D illustrates the contact arms 132 in a compressed position. The contact arms 132, and specifically the locking feature 136, may transition from a first height H1 to a second height H2 with respect to the groove 140. This height differential also corresponds to a height difference of the arms 132 over the top surface 144, and thus the height of the arms 132 above the top surface 144 may similarly increase/decrease depending on whether the contact arms 132 are in a compressed or extended position.

Referring again to FIGS. 4 and 5, the contact arms 132 may curve upward to form the electrical contact 134. This may allow the electrical contact 134 to be able to better contact the connection component 160 to form an electrical connection for electronic communication.

Additionally, the electrical contact 134 may be coated with, or may be formed from, a different material than the arm 132. For example, the electrical contact 134 may be an electrically conductive material, such as gold, copper, silver, certain polymers, and so on.

The connection component 160 may include a keying structure 162 and a communication or contact area 161. The communication or contact area 161 provides an electrical communication output for another component, e.g., for the audio receiver 110. The keying structure 162 matingly receives the keying structure 152 of the contact arm 132. In some embodiments, the keying structure 152 may be the only portion of the audio receiver 110 that may be in contact with the connection component 160. The corresponding keying structures 152, 162 may help to retain the connection, as the keying structure 152 of the audio receiver 110 may rest within the depression, detent, or other feature on the bottom of the connection component 160.

It should be noted that in some embodiments, the contacts for the connection component 160 may include the keying structure 162 and/or may include an exposed substantially flat electrical contact. In other words, the contact 134 of the contact arm 132 may be able to move around on the surface of the connection component 160 while still maintaining an electrical connection.

As the contact arms 132 are secured to two sides of the audio receiver 110, the contacts 134 may be substantially prevented from "walking" around the bottom of the connection component 160, even though the audio receiver 110 may vibrate while producing an output or may experience other forces (e.g., as when the device 100 is dropped). This may prevent the contacts 134 from collecting debris and deteriorating the electrical connection between the audio receiver 110 and the connection component 160.

Alterative Embodiments of the Audio Output Device

Figure 6:
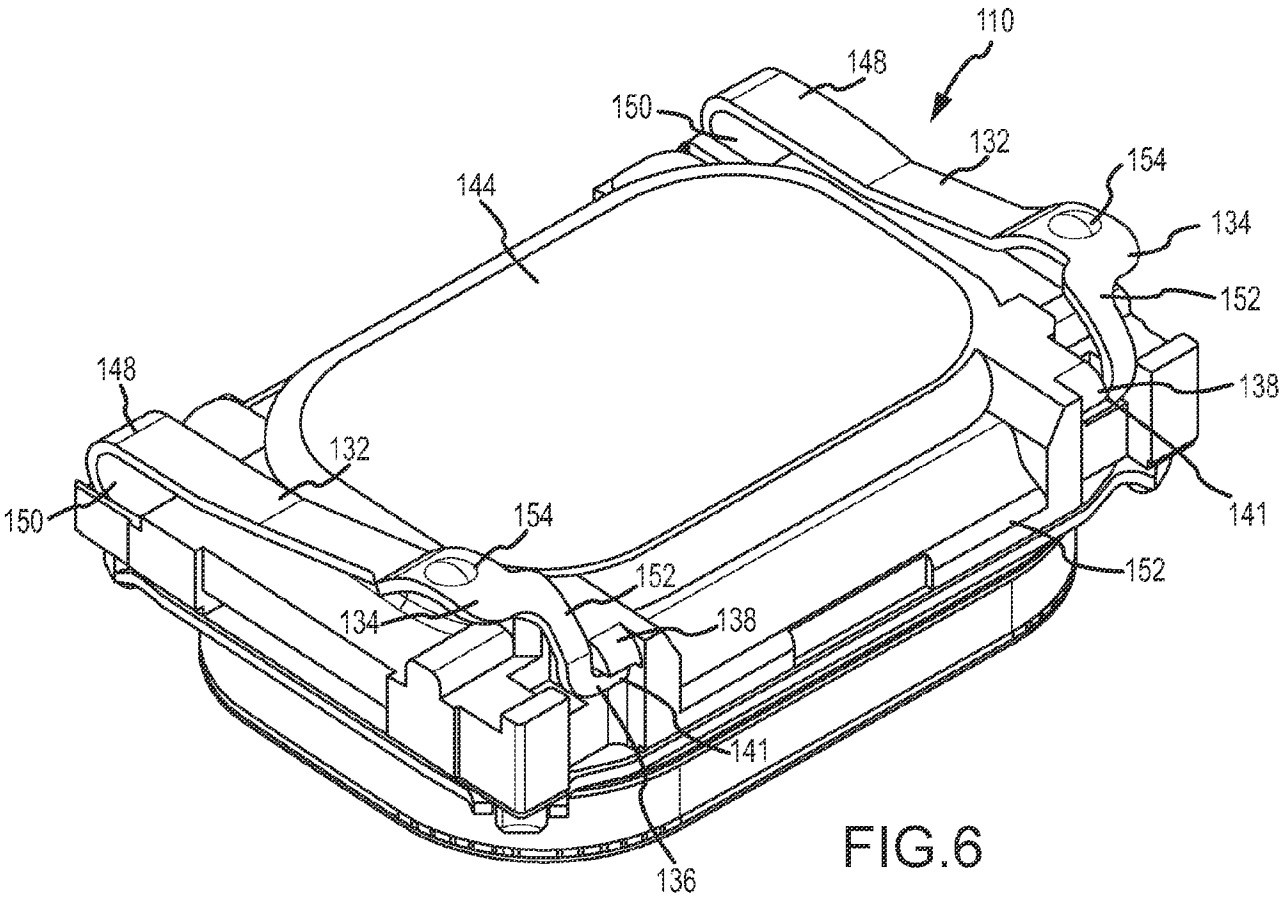
FIG. 6 is an isometric view of a second example of the audio receiver of FIG. 3A.

FIG. 6 is an isometric view of a second embodiment of the audio receiver 110. In this embodiment, the contact arms 132 may be slightly wider than in the audio receiver 110 illustrated in FIG. 3A. Additionally, the contact arms 132 may transition into the bend 152 in a curved manner, so that the locking feature 136 may be aligned at least partially off-center from the contact arm 132. For example, the bend 152 may be an "S" or other curved shape. In this embodiment, the base body extension 138 on the main body 152 of audio receiver 110 may be off-set from the base 150 of the contact arm 132. In other words, the contact arm 132 may be angled inwards towards a center of the audio receiver 110 as it traverses across the top surface 144 to couple to the base body extension 138. Furthermore, the contact arms 132 may also may traverse along a non-linear plane from the hinge 148 to the bend 152. For example, the contact arms 132 may have a depression in a middle portion and then extend back upward to form the contact area 134.

Further, the audio receiver 110 of FIG. 6 may also include an alterative locking feature 136. The locking feature 136 as shown in FIG. 6 may be a "L" shape only having a single branch 141 to interact with the body extension 138. In this embodiment, the locking feature 136 may be smaller, but may be more easily removed from the groove 140. This is because the single branch 141 may not prevent horizontal movement. Furthermore, the branch 141 may allow the locking feature 136 to be unlocked from the body extension 138 by providing a horizontal force to misalign the branch 141 from the body extension 138. To lock the contact arms 132, a horizontal force in the opposite direction may align the locking feature 136 branch 141 with the body extension 138. Thus, the contact arms 132 may be selectively unlocked and unlocked, to selectively secure the contact arms 132 to the second side 152 of the audio receiver 110.

Figure 7:
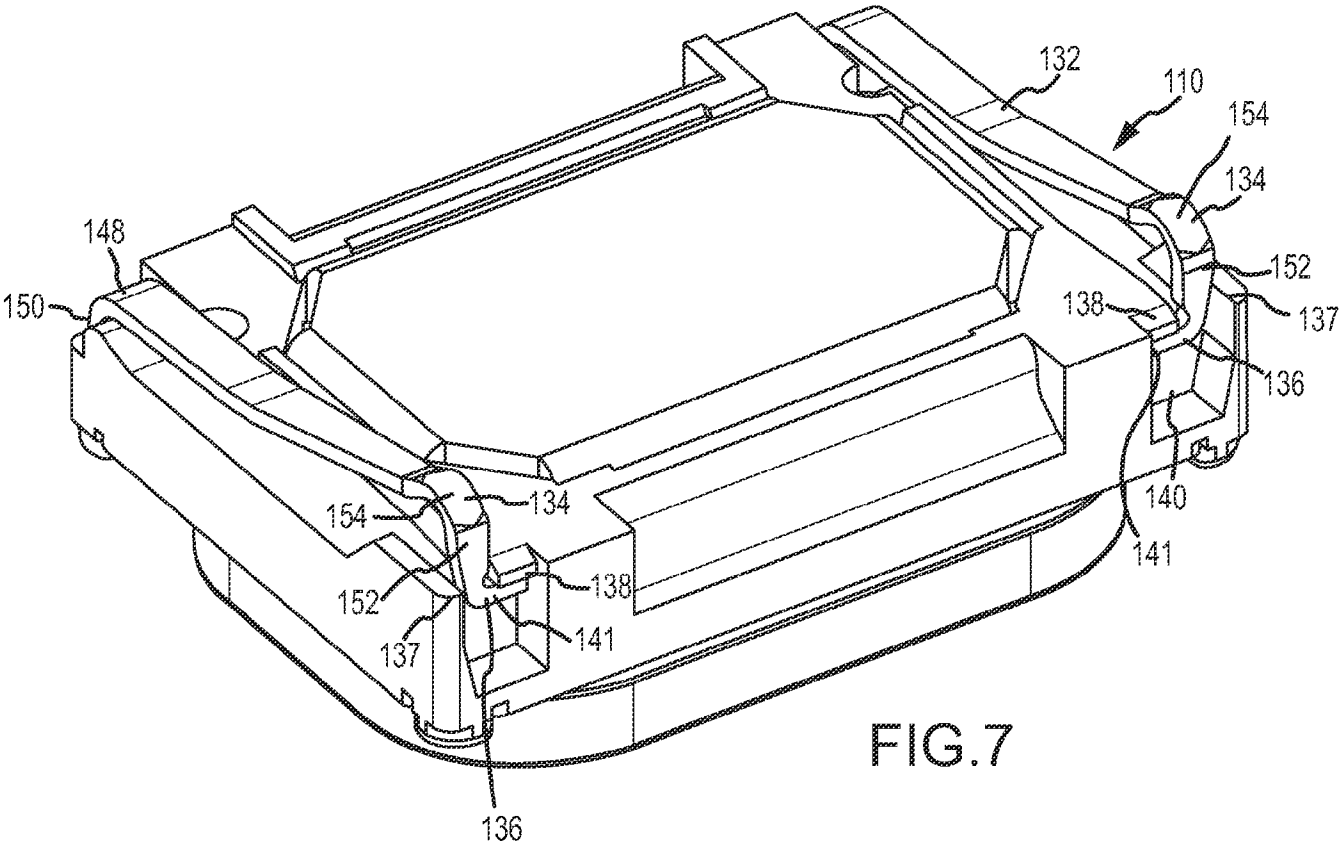
FIG. 7 is an isometric view of a third example of the audio receiver of FIG. 3A.

FIG. 7 is an isometric view of a second embodiment of the audio receiver 110. The audio receiver 110 in this embodiment may include contact arms 132 substantially similar to the audio receiver 110 of FIG. 3A. However, in this embodiment, the locking feature 136 may be the "L" shaped branch as shown in FIG. 6. As shown in FIG. 7, the main body 152 may include the first body extension 138 to engage the branch 141. Additionally, the main body 152 may include the second extension member 137 or side wall surrounding the groove 140 which may prevent the locking feature 136 from being disengaged with the groove 140.

The contact arms 132 may have a thinner width than the contact arms of FIG. 6. Additionally, the bend 152 in the audio receiver 110 of FIG. 7 may be substantially aligned with the middle portion of the contact arms 132, such that the branch 141 of the locking feature 136 may be aligned at least at one location with the middle portion of the contact arms 132. Further, the contact area 134 may be generally raised above a plane of the contact arms 132 and may not include a specific keying feature, such as the keying feature 154 of FIGS. 3A and 6.

Similar to the embodiment of the audio receiver 110 illustrated in FIG. 3A, the audio receivers illustrated in FIGS. 6 and 7 also flexibly secure the contact arms 132 to the main body 152. For example, the branch 141 of the L-shaped locking feature 136 engages the body extension feature 138 so that the contact arms 132 are secured to the second side 152 of the audio receiver 110, but also can move at least partially in a vertical direction.

Assembly of the Electronic Device

Figure 8A:
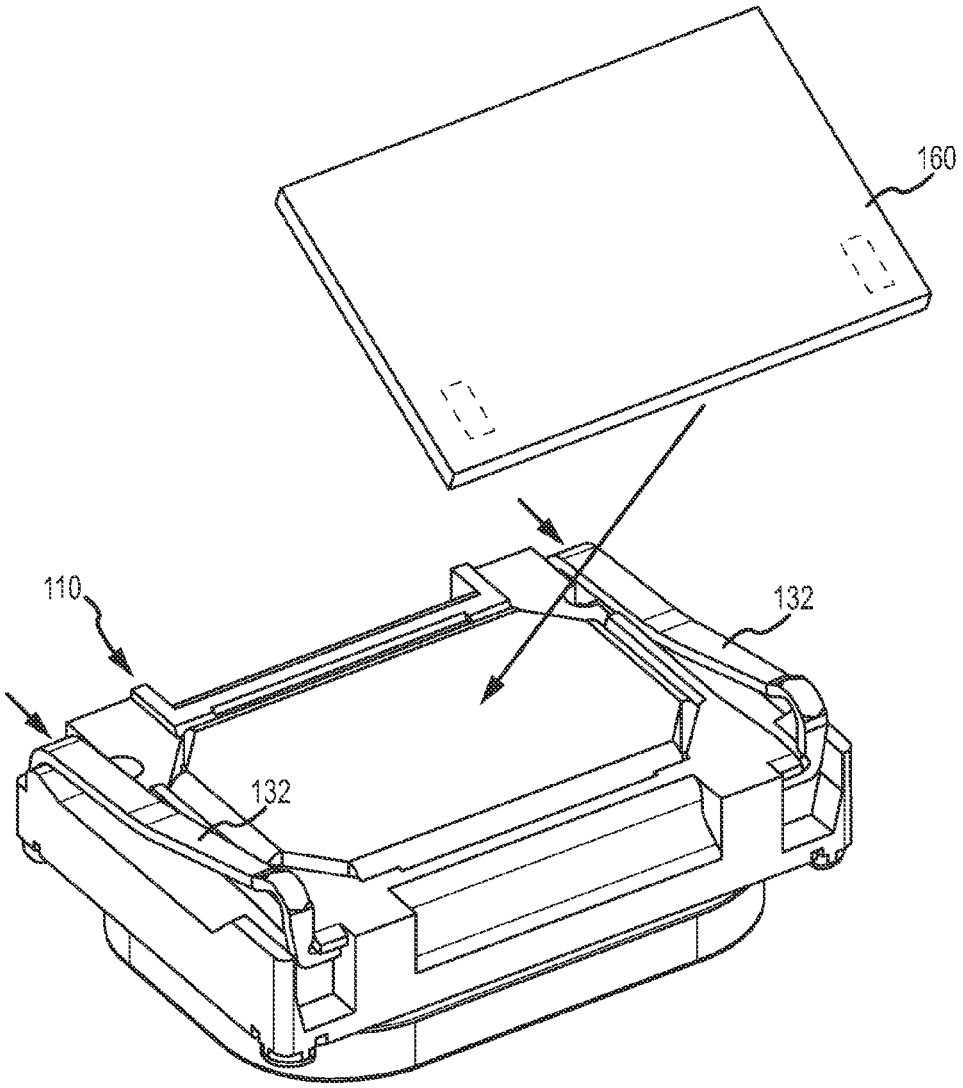
FIG. 8A is a diagram illustrating a first operation of an exemplary manufacturing process for assembling the electronic device of FIG. 1.
Figure 8B:
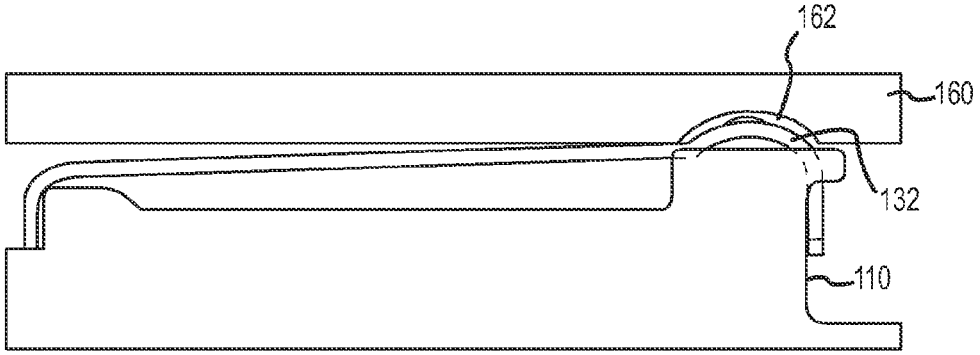
FIG. 8B is a diagram illustrating a second operation of the exemplary manufacturing process of FIG. 8A.

The audio receiver 110 may simplify the manufacturing assembly of the electronic device 100. FIG. 8A illustrates a first operation in the manufacturing process for the electronic device 100. FIG. 8B illustrates a second operation in the manufacturing process for the electronic device 100. In some embodiments, the connection component 160 may be slid over the top surface 144 of the audio receiver 110 at an angle with respect to the top surface 144. A sliding assembly may be beneficial over a vertical stacking assembly as each component may be positioned at essentially the same time and the likelihood of components being damaged due to forces is reduced.

In conventional audio output devices having non-secured electrical contacts, the sliding manufacturing assembly of the connection component 160 may cause the contacts to snag, break, deform, or become misaligned. This may be due to the sliding angled assembly of the connection component 160. Additionally, non-secured contacts may end or terminate upward at an angle, so that they can engage another component positioned above, thereby giving the connection component 160 on object to bend backward or misalign. However, as the contact arms 132 of the audio receiver 110 are looped and secured in place via the locking feature 136, the contact arms 132 may be substantially prevented from being deformed as the connection component 160 slides into place on top of and adjacent to the audio receiver 110 as shown in FIG. 8B.

Coupling Assembly

Figure 9:
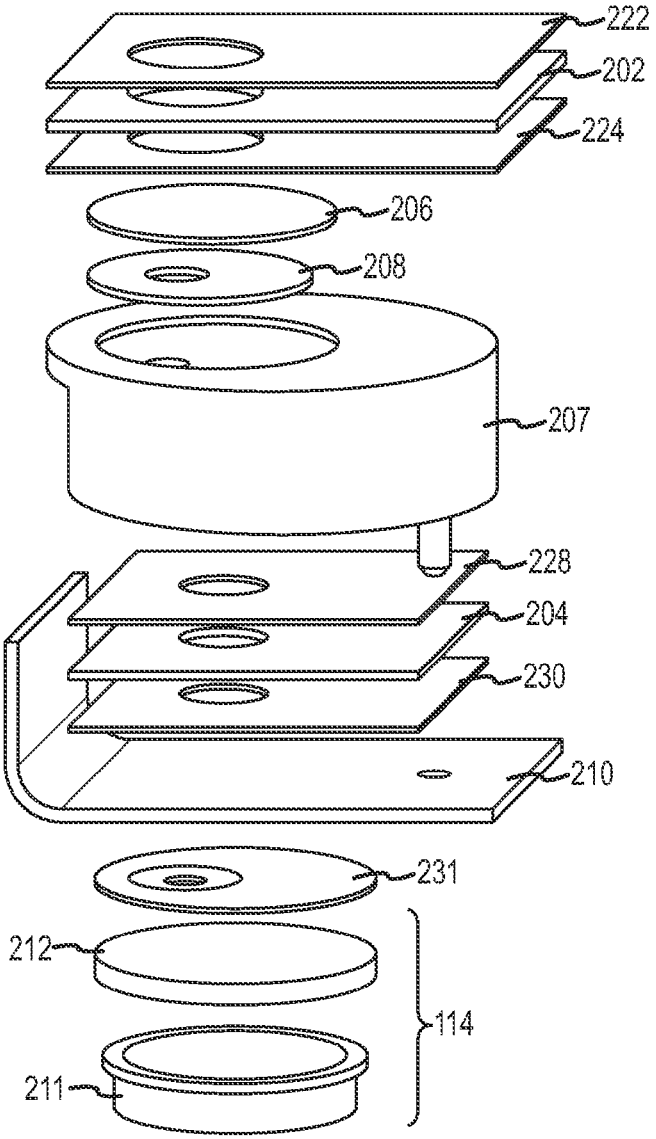
FIG. 9 is an exploded isometric view of a exemplary coupling assembly for an audio component of the electronic device of FIG. 1.
Figure 10:
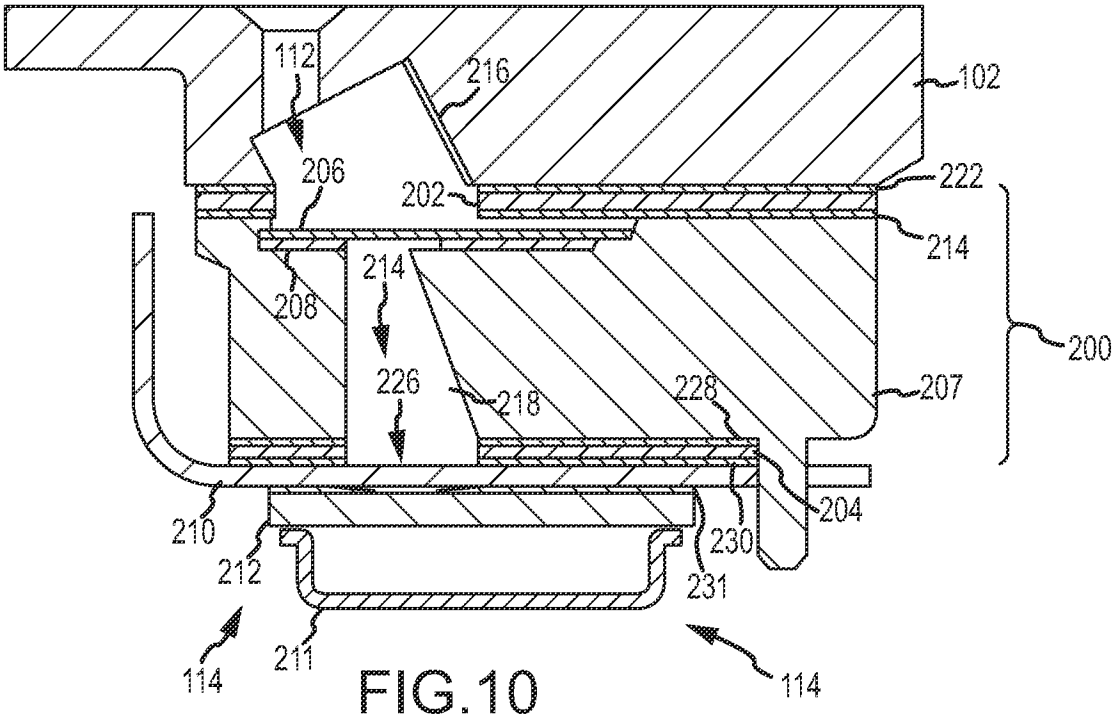
FIG. 10 is a cross-section view of the electronic device of FIG. 1 taken along line 10-10 illustrating the coupling assembly of FIG. 9.

FIG. 9 is an isometric view of a coupling assembly 200 for attaching the microphone 114 to the electronic device 100. FIG. 10 is a cross-section view of the electronic device taken along line 10-10 of FIG. 1. Referring to FIGS. 1, 9, and 10, the input port 112 within the enclosure 102 provides an acoustic pathway 214 from outside the enclosure 102 to the microphone 114. The coupling assembly 200 may be positioned substantially underneath the input port 112 and connected to the enclosure 102 such that air and sound waves may travel between the two. For example, the enclosure 102 may include a recess 216 in communication with the input port 112 and the coupling assembly 200 may be aligned with the recess 216.

The coupling assembly 200 increases the acoustic seal for the microphone 114 while at the same time decoupling the microphone 114 from the device 100. For example, the coupling assembly 200 compressively secures the microphone 114 to the enclosure 102 so as to create an acoustic seal and substantially prevent feedback and direct sound waves directly through the acoustic path 214 to the microphone 114. Additionally, the coupling assembly 200 further acts to "decouple" the microphone 114 from the enclosure 102 and the device 100 so that vibrations or other noise of the device 100 may not be sensed by the microphone 114.

The microphone 114 and the coupling assembly 200 may be operably connected to a cable 210 (or other electrical communication component). The cable 210 may be positioned substantially beneath the coupling assembly 200, adjacent to the microphone 114, and within the audio pathway 214. The cable 210 may be a flex cable, a printed circuit board, or substantially any other electrical component for transmitting electrical signals from the microphone 114.

The microphone 114 may be positioned beneath the coupling assembly 200 and a microphone boot 207 or may be positioned within the coupling assembly 200 (which will be discussed in more detail below). The microphone 114 may include a diaphragm 212, a can 211 for retaining the diaphragm 212, and an adhesive 231 or attachment member for attaching the microphone 114 to the cable 110.

The diaphragm 212 may be substantially any material that may convert acoustic sound waves into an electrical signal. For example, the diaphragm 212 may be a film of electret material, a condenser material, capacitive material, piezoelectric material, and so on. The diaphragm 212 may be positioned on the adhesive 231 or spacer member and connected to the cable 210 via the can 211.

A boot 207 assists in sealing the diaphragm 212 from noise signals that could potentially interfere with the sound waves. The boot 207 may be plastic, metal, or other suitable material. Further, the boot 207 may also include a cavity 218. The cavity 218 is in communication with the acoustic pathway 214. The diaphragm 212 may be positioned at least partially below the cavity 218 on a bottom side of the boot 207 after the cable 210 and coupling assembly 200.

The cavity 218 directs air that may be displaced by the vibration of the diaphragm 212 towards an opening (not shown).

An acoustic mesh 206 may be positioned between the boot 207 and the enclosure 102, and attached to the boot 207 by adhesive 208. The acoustic mesh 206 may help to seal the acoustic pathway 214 and prevent debris from entering into the microphone 114 via the input port 112 (which may be exposed to outer side of the enclosure 102).

The coupling assembly 200 secures the microphone 114 and in some embodiments the boot 207 to the enclosure 102 and to the device 100. The coupling assembly 200 may include a first resilient member 202 and a second resilient member 204. As shown in FIG. 10, the microphone 114 may be coupled to the enclosure via the two resilient members 202, 204. The resilient members 202, 204 may be substantially any type of resilient element, such as but not limited to, foam, springs, and so on. In one embodiment, the resilient members 202, 204 may be open cell foam, low density foam, or foamed plastic.

The resilient members 202, 204 may have a low spring force, such that there may be a high ratio between the microphone 114, the boot 207, and the resilient members 202, 204. In one example, the resilient members 202, 204 may be substantially easily compressed. It should be noted that the spring force or rate of the resilient members 202, 204 may be varied depending on the desired coupling and/or the structure. In some instances, the resilient members 202, 204 may be thicker and therefore the spring rate may be increased as compared with a same material for the resilient member 202, 204 that is thinner.

Each of the resilient members 202, 204 may also include an opening 216, 226 to allow air and sound waves to communicate therethrough. Additionally, the resilient members 202, 204 may be operably connected to the enclosure 102, the microphone 114 and the cable 110 via adhesive 222, 224, 228, 230.

In one embodiment, a top surface of the first resilient member 202 may be operably connected to the enclosure 102 via the first adhesive 222. A bottom surface of the first resilient member 202 is operably connected to a top surface of the acoustic mesh 206 via the second adhesive 224. A top surface of the second resilient member 204 is operably connected to the bottom surface of the boot 207 via a third adhesive 208 and a bottom surface of the second adhesive 204 is operably connected to the cable 210 via the fourth adhesive 239.

The adhesive 222, 224, 228, 230 secures the resilient members 202, 204 to the enclosure 102, the microphone 114 (via the cable 110) in a secure manner so as to form a seal with each component. In other words, the adhesive 222, 224, 228, 230 compresses the enclosure 102, the microphone 114, and the boot 207 together. In this manner, air and sound waves that enter through the acoustic pathway 214 may be directed towards the microphone 114 without being able to be dispersed or otherwise attenuated. Furthermore, the compressive stack formed of the enclosure 102, the resilient members 202, 204, the microphone 114, and the cable 210 and boot 207 may substantially prevent sound waves from entering into the microphone 114 other than through the input port 112, and the acoustic pathway 214. This because the adhesives 222, 224, 228, 230 act to create a seal between the enclosure 102 and the boot 207 and the coupling assembly 200 and the microphone 114.

The enclosure 102, the coupling assembly 200 and the boot 207 create a compressive stack for the microphone 114. The compressive stack provides a seal around the microphone 114 (to allow for better sound sensing) while at the same time the coupling assembly 200 isolates the microphone 114 from unwanted noise or vibrations. The better the compressive force of the stack, the better the acoustic seal may be, as the acoustic seal may not only depend on the compressive strength of the adhesives securing each component together. Thus, the coupling assembly 200 allows for the microphone 114 to have a good acoustic seal while still being operably coupled to the device 100. This is possible as the microphone 114 is substantially suspended from the enclosure 102 by the resilient members 202, 204, isolating the microphone 114 from vibrations of the device. The coupling assembly 200 may prevent feedback in the microphone 114, although the microphone may be high gain and configured to sense multiple frequencies, and so on.

The coupling assembly 200 may better isolate the microphone 114 from the device 104, while still providing an acoustic seal due to the compressibility of the resilient members 202, 204. For example, if the resilient members 202, 204 were not compressed then coupling assembly 200 may not provide an acoustic seal for the microphone 114. Similarly, although high dampening materials may generally provide better isolation from vibrations than other materials, when compressed these materials may transmit vibrations therethrough. As briefly explained above, if the microphone 114 is positioned in a non-compressive stack or other assembly, the acoustic seal may be degraded.

Essentially, the coupling assembly 200 provides for a microphone seal that attaches and seals the microphone 114 to the device 100 while at the same time isolating the microphone 114 from the device 100.

In one embodiment, the microphone 114 may be positioned between the resilient members 202, 204 at the location of the boot 20. That is, the microphone 114 may be suspended or sandwiched between the two resilient members 202, 204. In this embodiment, the boot 207 may be omitted, or the microphone 114 may be positioned within or directly beneath the boot 207. The resilient members 202, 204 may then be positioned on either side of the microphone 114 to create a spring, mass, spring assembly, with the resilient members 202, 204 acting as a springs as the microphone 114 acting as the mass suspended between the two springs. This embodiment may provide for isolation from vibrations of the devices. However, the isolation of the embodiment illustrated in FIG. 10, having two masses (specifically, boot 207 and microphone 114) may include an additional layer of isolation, and thus may better separate the microphone 114 from vibrations of the device 100.

In a second embodiment, only a single resilient member 202 may be utilized to operably connect the microphone 114 and/or boot 207 to the enclosure 102. In this example, the bottom resilient member 204 may be omitted. As there may fewer resilient members, this embodiment may provide less isolation from vibrations, but may be less expensive to produce as fewer components may be necessary.

In operation, when the actuator 130 produces vibrations in the device 100 (e.g., when a vibration alert is activated), the resilient members 202, 204 may substantially isolate the microphone 114 from detecting these vibrations and transmitting a sound. This because the microphone 114 acts as a mass suspended between two springs (the resilient members 202, 204) and although it may move with the vibrations, it may not experience the vibrations.

Conclusion

The foregoing description has broad application. For example, while examples disclosed herein may focus on the contact arms for an audio output device, it should be appreciated that the concepts disclosed herein may equally apply to contact arms for other electrical components. Similarly, although the coupling assembly may be discussed with respect a mobile electronic device, the devices and techniques disclosed herein are equally applicable to other types of devices. Accordingly, the discussion of any embodiment is meant only to be exemplary and is not intended to suggest that the scope of the disclosure, including the claims, is limited to these examples.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

What is claimed is:

1. An electronic device comprising:
- a processor;
- a connection component in communication with the processor; and
- an audio output device in communication with the connection component, the audio output device comprising:
  - a body;
  - at least one contact arm operably connected at a first end to a first location of the body and at a second end to a second location of the body;
  - a base body extension extending from the body adjacent to the second location, and configured to prevent the second end of the contact arm from disconnecting from the second location;
- wherein:
  - the contact arm operably couples the audio output device to the connection component.

2. The electronic device of claim 1, wherein the first location is a right side of the audio output device and the second location is a left side of the audio output device.

3. The electronic device of claim 1, wherein the at least one contact arm can move between a first height and a second height.

4. The electronic device of claim 3, wherein the at least one contact arm is substantially prevented from moving in at least two directions.

5. The electronic device of claim 1, wherein at least one contact arm further comprises a hinge substantially adjacent the first end.

6. The electronic device of claim 1, wherein the at least one contact arm further comprises a locking structure configured to substantially prevent the at least one contact arm from moving in at least one direction.

7. The electronic device of claim 6, wherein the at least one locking structure forms the second end of the at least one contact arm.

8. The electronic device of claim 1, further comprising at least one keying structure corresponding to a keying feature of the connection component.

9. The electronic device of claim 1, wherein the connection component is a printed circuit board.

10. An electronic device comprising:
- an audio component configured to couple to an electrical circuit, the audio component comprising:
  - a body comprising:
    - a first sidewall;
    - a second sidewall opposite the first sidewall;
    - an exterior surface joining the first sidewall and the second sidewall; and
    - a base body extension extending outwardly from the second sidewall; and
  - an electrically conductive arm disposed across the exterior surface, the electrically conductive arm comprising:
    - a first end coupled to the first sidewall; and
    - a second end configured to engage the base body extension;
- wherein the electrically conductive arm couples the audio component to the electrical circuit.

11. The electronic device of claim 10, wherein the electrically conductive arm can move between a first height and a second height relative to the exterior surface.

12. The electronic device of claim 10, wherein the electrically conductive arm is substantially prevented from moving in at least two directions.

13. The electronic device of claim 10, wherein the electrically conductive arm comprises a hinge adjacent the first end.

14. The electronic device of claim 10, wherein the electrically conductive arm further comprises a locking structure configured to engage with the base body extension.

15. The electronic device of claim 14, wherein the at least one locking structure forms the second end of the electrically conductive arm.

16. The electronic device of claim 14, wherein the at least one locking structure forms the second end of the electrically conductive arm as a "T" shape configured to engaged the base body extension.

17. The electronic device of claim 10, further comprising at least one keying structure corresponding to a keying feature of the connection component.

18. An electronic device comprising:
- a processor;
- a connection component in communication with the processor and comprising a keying recess; and
- an audio component in communication with the connection component, the audio component comprising:
  - a body;
  - at least one contact arm comprising:
    - a first end configured to couple to a first location of the body;
    - a second end opposite the first end and configured to couple to a second location of the body opposite the first location; and
    - a keying portion between the first end and the second end;
- wherein:
  - the keying portion is configured to be received within the keying recess; and
  - the keying portion operably couples the audio component to the connection component.

19. The electronic device of claim 18, wherein the audio component comprises an audio output device.

20. The electronic device of claim 18, wherein the at least one contact arm is formed from an electrically conductive material.

21. The electronic device of claim 18, wherein the at least one contact arm is substantially prevented from moving in at least two directions.

* * * * *